US005501062A

United States Patent [19]

Ambergen et al.

[11] Patent Number: 5,501,062

[45] Date of Patent: Mar. 26, 1996

[54] PROCESS AND MACHINES FOR MANUFATUURING ONE-PIECE BOXES AND BOXES MADE THEREBY

[75] Inventors: G. Ambergen, Oldenzaal; O. van Dijk, Enschede, both of Netherlands

[73] Assignee: AGI Incorporated, Melrose Park, Ill.

[21] Appl. No.: 72,508

[22] Filed: Jun. 3, 1993

[51] Int. Cl.[6] ..... B65B 3/02

[52] U.S. Cl. ..... 53/452; 53/266.1; 53/456; 493/110; 493/111; 206/597

[58] Field of Search ..... 53/226.1, 452, 53/456, 558, 561; 229/103.2, 116.1; 206/387; 493/10, 54, 110, 111

[56] References Cited

U.S. PATENT DOCUMENTS

| | | | |
|---|---|---|---|
| 1,827,442 | 10/1931 | Stokes | 493/334 |
| 1,851,518 | 3/1932 | McGovern | 493/111 X |
| 1,865,159 | 6/1932 | Adamson | 493/111 X |
| 2,015,202 | 9/1935 | Stokes | 493/59 |
| 2,111,157 | 3/1938 | Stokes | 493/110 |
| 4,641,750 | 2/1987 | Johnson et al. | 206/387 |
| 4,771,886 | 9/1988 | Johnson | 206/387 |
| 5,369,938 | 12/1994 | Panveno et al. | 53/456 |

*Primary Examiner*—W. Donald Bray
*Attorney, Agent, or Firm*—Weil, Gotshal & Manges

[57] ABSTRACT

The present invention comprises a process for manufacturing a single piece multi-purpose box from a board blank and a wrap. The process includes a method and machine for score setting the spine of said single-piece box so that the wrap does not separate from the board blank after continued opening and closings of the box. Moreover, the present invention teaches a method of closing said boxes in-line in an upright position which results in ready counting and packing of said boxes.

47 Claims, 6 Drawing Sheets

PROCESS AND MACHINES FOR MANUFATUURING ONE-PIECE BOXES AND BOXES MADE THEREBY

BACKGROUND OF THE INVENTION

It is desirable to make boxes in a quick and efficient manner to manufacture them inexpensively. It is also desirable to make boxes with aesthetic appeal to entice customers to buy the product within the box.

It has been known in the art to make single piece boxes where the top and bottom of the box are one connected unit, see, e.g., U.S. Pat. Nos. 4,771,886 and 4,641,750. Boxes made according to these patents, however, may only be made from materials that may be molded, and the manufacturing processes require a separate step in which a label may be affixed to the boxes.

Processes are also known for forming single-piece boxes from two pieces, a board blank and a wrap, wherein the wrap primarily functions as a decoration or a label. Previously known processes of this type, however, do not provide for a sealed spine so that the wrap at the spines of the boxes formed by said prior art processes have a tendency to bunch up and separate from the board blank. Additionally, the prior art processes for making one-piece boxes have not provided for automatic stacking and counting of boxes made thereby, but rather have required manual counting of the boxes.

SUMMARY OF THE INVENTION

The present invention comprises an apparatus and process for manufacturing a single piece multi-purpose box from a board blank and a wrap. The spine region of the wrap and the spine of the board blank are sealed together so that the wrap does not separate from the blank at the spine of the box. Additionally, the present invention provides for automatic stacking and counting of boxes made according to the present invention.

DETAILED DESCRIPTION OF THE INVENTION

Figure 1:
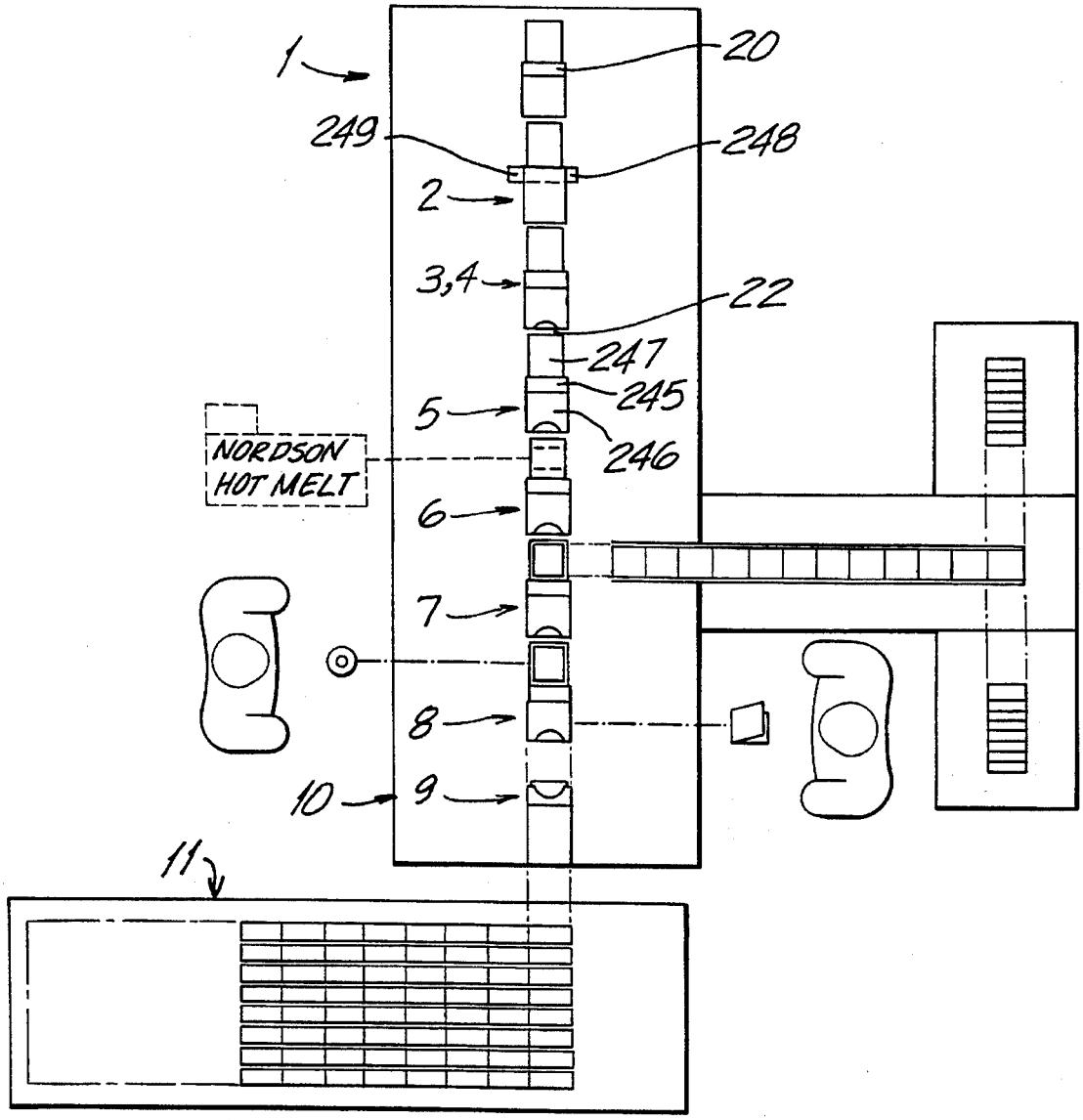
FIG. 1 represents a plan view of a schematic diagram of the process of the present invention for making a one-piece box.
Figure 2:
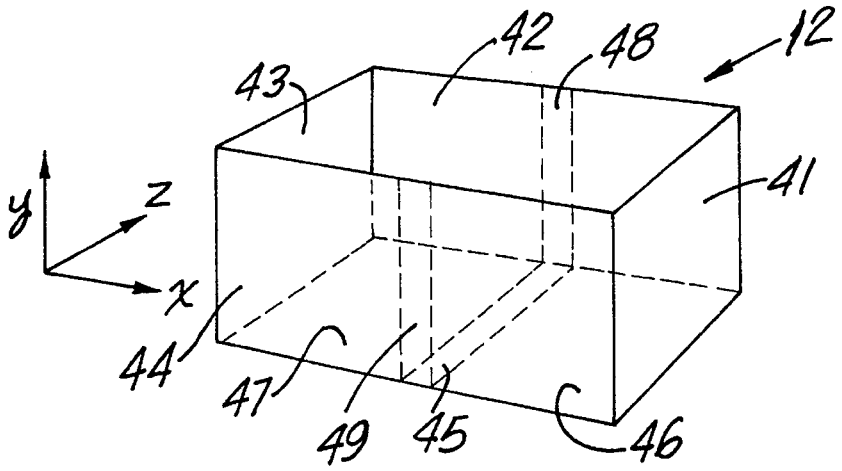
FIG. 2 illustrates a perspective view of a board blank to be used in the present invention.

Referring to the figures, the present invention involves a process 1 wherein a board blank 12 (FIG. 2) and a wrap 19 (FIG. 3) are aligned, wrapped, cut, stamped and bent to form a single-piece box. Additional steps may be added to the process to insert items into the box, such as compact disk trays and compact disks. Moreover, steps of closing, sealing and counting boxes may be included in a process of the present invention.

A board blank 12 for use in the present invention comprises two rectangular regions 46, 47 which will ultimately form, respectively, the top and bottom surfaces of the box, an intermediate spine region 45, and four walls 41, 42, 43, 44 which will ultimately form the walls of the box. The boundary lines separating the walls 41–44 from the top and bottom regions are scored through about 70–80% of the thickness of the blank material, on the side of the blank 12 that will form the exterior of the box, to facilitate bending of the wall regions approximately 90 degrees to an orientation perpendicular to the orientation of the bottom region 47 to form the walls of the box. The boundary lines between the spine region 45 and the top and bottom regions 46, 47 are channel scored at about a width of one-eighth of an inch.

Notches 48, 49 in the walls 42,44 on either side of the spine region 45, adjacent to the spine region 45 and of the same width as the spine region 45 may be made. These notches 48, 49 may be used as guides by which the board blank 12 and the wrap will be aligned during assembly of the box and will eliminate the necessity of cutting such notches during the formation of the box.

Since the top of the box, once assembled, nests over the bottom of the box, the top region 46 must be slightly larger in both dimensions than the bottom region 47. The length of the top region 46, measured, in the sense of the Figures, in the x direction, must be at least one thickness of the board blank material and two thicknesses of the wrap material wider than the bottom region 47. The width of the top region 46, measured, in the sense of the Figures, in the z direction, must be at least two thicknesses of the board blank and four thicknesses of the wrap material longer than the bottom region 47. The length of the spine region 45, measured, in the sense of the Figures, in a z direction, is equal to the width of the top region 46.

The length of the wall 42, 44 measured, in the sense of the Figures, in the x direction, is equal to the sum of the lengths of the bottom region 47 and top region 46 and the width of the spine region 45 and has a height measured, in the sense of the Figures, in a y direction, equal to the width of the spine region 50. The length of the wall 43 measured, in the sense of the Figures, in a z direction, is equal to the length of the bottom region 46 and the height of the wall 43, measured, in the sense of the Figures, in the y direction, is equal to the height of the walls 42, 44.

The length of the wall 41, measured, in the sense of the Figures, in a z direction, is equal to the width of the top region 47 and has a height measured, in the sense of the Figures, in a z direction, equal to the height of the wall 42, 44.

One may optionally form a shape, such as a v-cut, in the wall 41 that lies alongside the top region 46, so that upon formation of the box there is a notch with which to open the box. The shape should be formed along the edge of the wall 41 distant from the top region 46. It is preferred to put the cut in the wrap as well as the board, so that the cut may be covered by the wrap as part of the formation procedure, but one can alternately put such a cut in the wall 41 alongside the top region 46 after the box is formed. However, such cuts after the wrap is wrapped onto the board blank leave rough edges, which are to be avoided.

The board blank 12 may be formed so that upon creation it has its three-dimensional shape, e.g., in a plastic mold. More commonly, however, the board blank 12 is formed from a flat piece of material that is die-cut, with the necessary cuts and channels in the material as described before. The walls 41–44 of the board blank 12 are bent along the boundary line between the walls 41–44 and the top and bottom regions 46, 47. The walls are bent away from the side in which the cuts were made to an orientation perpendicular to the orientation of the top and bottom regions 46, 47 and so that the walls 41, 43 are perpendicular to the orientation of the wall regions 42, 44. The junctures of the walls 42, 44 with the walls 41, 43 form the four comers of the blank 12. These comers are joined by appropriate means, e.g., gluing or taping, to secure the comers. A machine known in the art as a quad stayer, as is manufactured by Crathern & Smith, Inc. (of Huntingdon Valley, Pa.) (Model QA-100), may be used to bend and tape the flat board blank.

The board blank 12 is made of a material that provides sufficient structural strength to the box. Additionally, if the blank is not preformed to the desired specifications, the material must be capable of being die-cut from about 70% to about 80% of its thickness so as to be able to form the walls and the spine of the box. Suitable materials for the board blank include plastics, cardstock, and cardboard, with 40 point chipboard being a preferred material.

Figure 3:
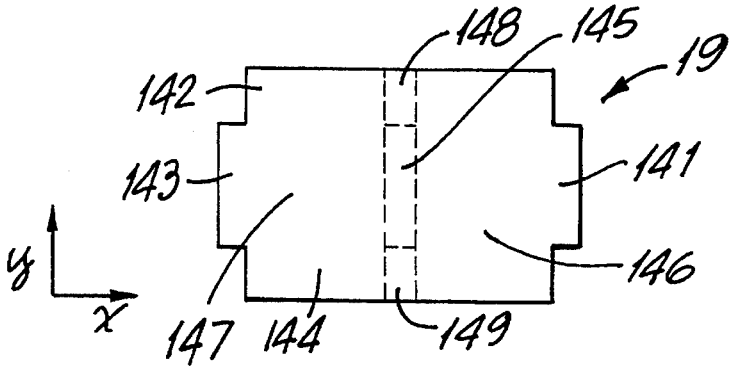
FIG. 3 illustrates a plan view of a wrap to be used in the present invention.

As shown in FIG. 3, a wrap 19 for use in the present invention comprises two rectangular areas 146, 147, which will ultimately cover the top 46 and bottom 47 surfaces of the box, respectively, an intermediate spine region 145 between the top and bottom regions 146, 147, and four tabs 141, 142, 143, 144 which will ultimately cover the walls 41–44 of the box. These regions and areas have been designated for the purposes of describing the shape of the wrap 19 only and are not actual cuts in the wrap 19.

Notches 148, 149 in the tabs on either side of the spine region 145 and adjacent to the spine region 145 may be of the same width as the spine region 145. These notches may be used as guides by which the board blank 12 and the wrap 19 are aligned during assembly of the box if the board blank has such notches as well. Moreover, if such cuts are pre-formed, they will avoid two steps in the process later.

The length of the top region 146, measured, in the sense of the Figures, in the x direction, must be as long as the top region 70. The top and bottom regions 146, 147 are slightly larger in size than the top and bottom regions 46, 47 of the board blank 12, respectively, to cover the edges of the board blank 12 when the box is bent. The length of the spine region 145, measured, in the sense of the Figures, in the y direction, is equal to the length of the spine region 45 of the blank. The width of the spine region 145, measured, in the sense of the Figures, in the x direction, is equal to the width of the spine region 45 of the blank.

The length of the tab regions 142, 144 measured, in the sense of the Figures, in the x direction, is equal to the sums of the length of the bottom region 147, the length of the top region 146 and the width of the spine region 145, and they have a width measured, in the sense of the Figures, in the y direction, that is greater than the height of the walls 142, 144.

The length of the tab region 143 measured, in the sense of the Figures, in the y direction, is equal to the width of the bottom region 147 and the width of the tab 143, measured, in the sense of the Figures, in the x direction, is greater than the height of the wall region 43.

The length of the tab 141, measured, in the sense of the Figures, in the y direction, is equal to the width of the top region 146 and the width of tab 141 measured, in the sense of the Figures, in the x direction, is greater than the width of the wall 41.

One may optionally form a shape, such as a v-cut, in the tab 141 that lies alongside the top region 146, so that upon formation of the box there is a notch with which to open the box.

A wrap may be cut to the desired specifications or may be directly formed to the desired specifications.

The tabs of the wrap 141, 142, 143, 144 may be cut so as to prevent gapping of excess material of the wrap when the tabs 141–144 are placed over the walls 41–44 of the board blank 12. This may include cutting the tabs 141–144 at their juncture with the top or bottom regions 146, 147 to remove such excess material.

A wrap 19 for use in the present invention may be made from various materials including paper, fabrics and plastics which must be flexible and preferably should be strong enough to add structural strength to the box. The wrap may be printed or laminated on the side that will remain exposed after the box is formed to provide decoration or a label to the box.

Once the board blank 12 and the wrap 19 have been formed, an adhesive is placed on the non-laminated or non-printed side of the wrap. This may be done mechanically by a machine known in the art as a gluer.

After the adhesive is applied, the board blank 12 is placed on top of the wrap 19 with the top and bottom regions of the board blank 12 in contact with the top and bottom regions of the wrap 19, respectively. If the notches have been pre-cut, the edges of the tabs and walls that form the boundary of the notches must be aligned. These edges must run contiguously and one should be able to trace a straight line along all of these edges from the wrap 19 to the board blank 12. Additionally, the edges of the notches at the spine region should be parallel and should be adjacent to the edges of the notches at the spine region. Once the notches are aligned, the top regions 46, 146 and bottom regions 47, 147 of the board blank 12 and wrap 19 will be aligned, respectively, as a consequence. Given that the size of the spine of the box may be relatively small, e.g., ¼", this alignment by the notches must be made with a small tolerance for error. However, where the notches will be cut at a later time, the tolerance need not be so tight.

This alignment may be accomplished by a variety of methods including, manually, using a box spotter, as is made by Crathern & Smith or using an in-line scanner as is disclosed in co-pending commonly-assigned U.S. patent application Ser. No. 08/009,823.

Figure 4:
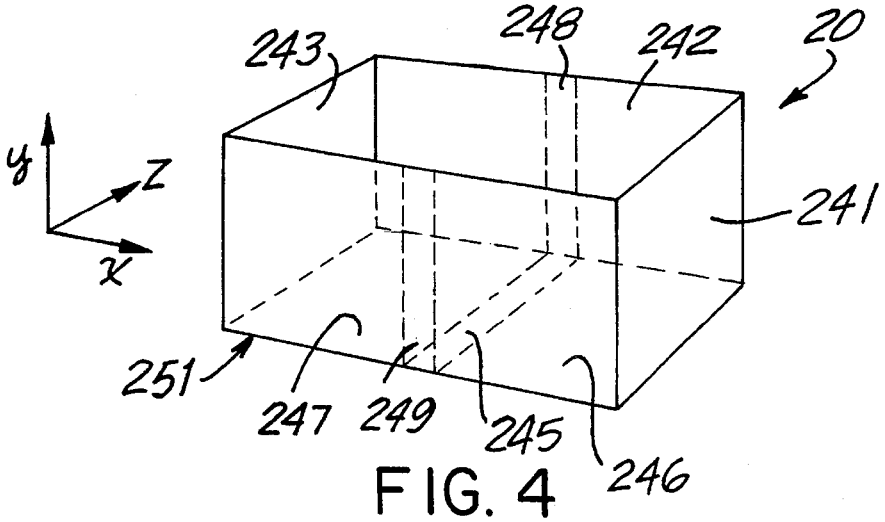
FIG. 4 illustrates a perspective view of a wrapped blank.

The wrap 19 is then wrapped around the board blank 12 so that the walls 41, 44 of the board blank 12 are covered by the tabs of the wrap 141–144, respectively, resulting in a wrapped blank 20 (FIG. 4). This may be accomplished in a machine called a wrapper which is available from Crathern & Smith.

If the notches have not been pre-cut into the wrap 19 and board blank 12, then the wrapped blank 20 is fed to a vertical notch cutter 2 and a horizontal notch cutter 3. Said notch cutters 2, 3 cut notches 248, 249 into the wrapped blank 20.

The wrapped blank 20 may additionally have a thumb notch 22 cut into it by a thumb notch cutting station 4. The notch 22 allows for easy opening of the box. Such a notch 22 may consist of a half circle cut or v-shape in the wall 241 parallel to the spine 250 along the top region 246 of the wrapped blank 20 and along the side of the wall 241 not adjacent to the top region.

The wrapped blank 20 with notches, either pre-cut notches as disclosed in commonly assigned co-pending U.S. patent application Ser. No. 08/009,823 or notches that have been the notch cutters 2, 3, is fed into a score setting machine 5. Said machine has the surprising result of vastly improving the hold of the wrap 19 on the blank 12 so that the wrap does not come off the board blank in the spine/notch area 245 of the box. The spine area is very susceptible to such separation because at the spine region the box is flexed to open and close and is subject to stresses that harm the box. The score setting machine 5 provides a major improvement over those boxes previously produced and yields a high quality, durable box.

Figure 5:
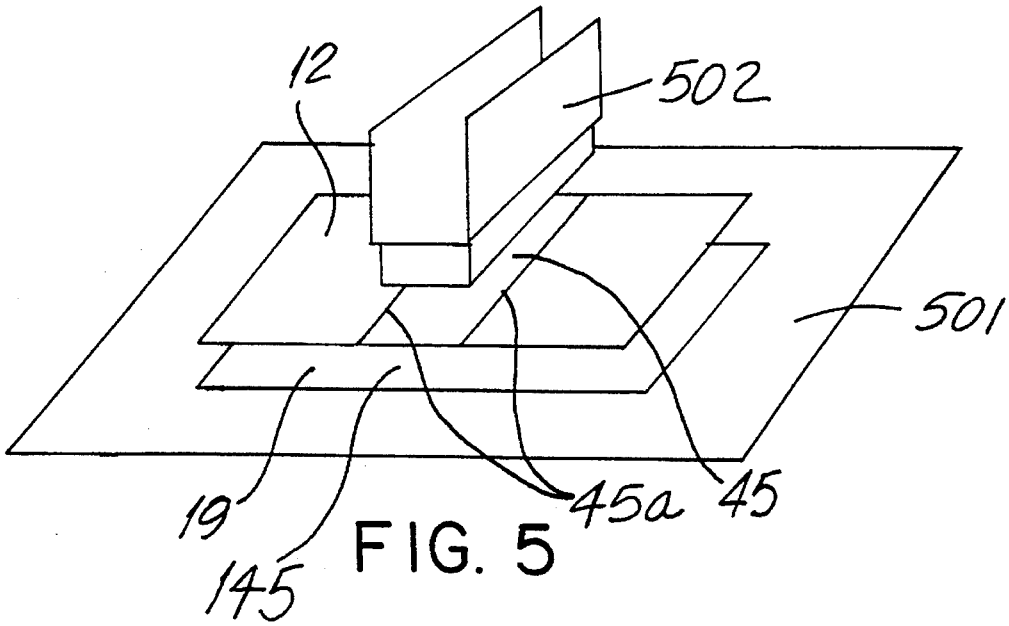
FIG. 5 illustrates the spine of a wrapped blank being sealed.

The score setting process includes striking the wrapped blank 20 against base 501 (FIG. 5). The wrap 19 which has been glued to the blank 12 rests against a flat surface. A die 502 is then brought down against the either the spine region 45 or along the two scored indentations 45*a* of the blank 12. The region of the blank 12 which is struck (either the spine region 45 or the indentations 45*a*) then strikes against the wrap 19 which then is impressed upon the flat base 501. This results in the board blank 12 being firmly joined to the wrap 19, especially at the scored area 45*a* which is so susceptible to separation during the opening and closing of the box.

Figure 7:
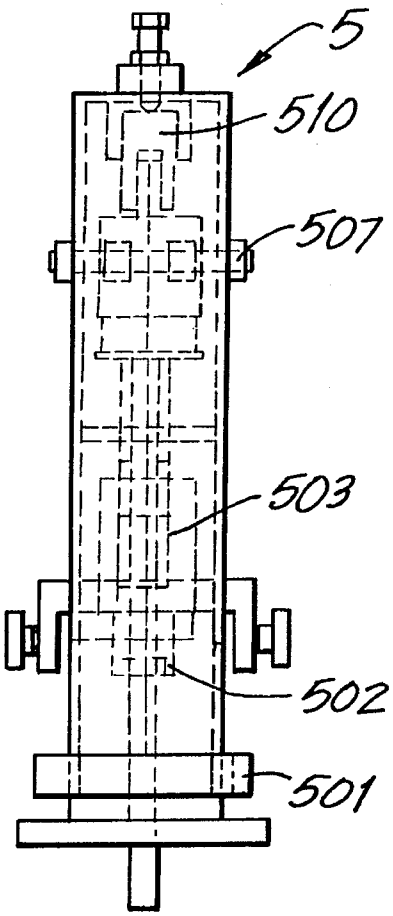
FIG. 7 illustrates a side view of a score setting station.

The score setting station 5 (FIGS. 6, 7) is comprised of a flat base 501 on which the wrapped blank 20 rests, a die 502 attached to a horizontal bar 503, the ends of which are attached to frame 504 in a manner permitting the bar to rise and fall, while maintaining its horizontal orientation. Drive means 505 is attached to bar 503 to control its vertical movement. Drive means 505 pushes the horizontal bar 503 along the frame 504 and thereby the die 502 down onto the wrapped board blank 20 against the base 501. The flat base 501 is essentially an anvil upon which the die 502 strikes.

Figure 6:
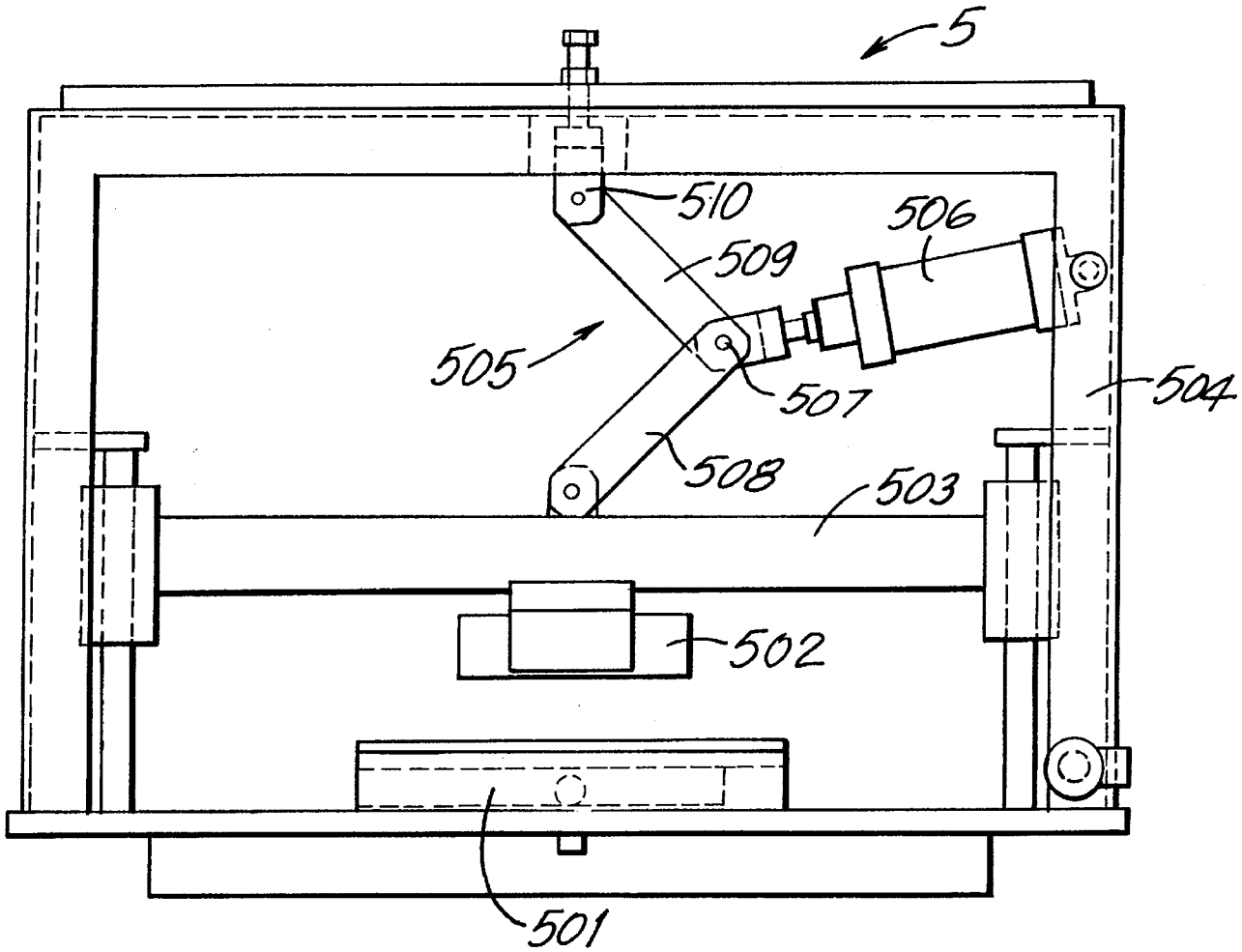
FIG. 6 illustrates a front view of a score setting station.

Drive means 505 comprises the means for driving the scoring die 502 into the wrapped blank 20. It may comprise a piston assembly 506 and linkage bars 508 and 509, the intermediate ends of which are joined at pivot 507. The other end of bar 509 is fixed to the frame 504 at connector 510, and the other end of bar 508 is pivotally attached to bar 503. When the piston 506 extends from the piston head, it forces the pivot point to the left, as shown in FIG. 6, in turn forcing linkages 508 and 509 to assume a more nearly vertical orientation, thereby driving bar 503 downward.

Figure 8:
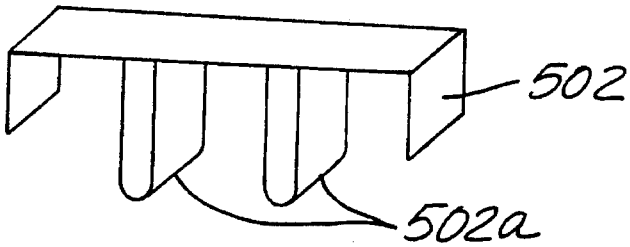
FIG. 8 illustrates a cut-away cross-section of a die for use in a score setting-station.
Figure 9:
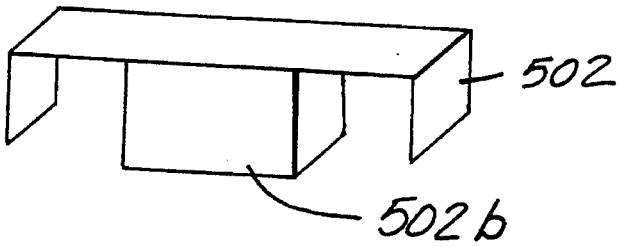
FIG. 9 illustrates a cut-away cross-section of a die for use in a score setting-station.

The die 502 has two embodiments. One embodiment comprises two pieces of creased rule 502*a* (FIG.8). The bottoms of these two pieces of creased rule 502*a* strike the wrapped blank 20 at the scored lines 45*a* separating the bottom 247 and top 246 region, respectively, from the spine region 250. A preferred form of this embodiment allows for the two pieces 502*a* to be moved so that the may be readily adjusted for spines of different widths. Another embodiment of the die is where there is a single block 502b which strikes along the entire spine region 245.

The die 502 should strike the wrapped blank 20 with sufficient pressure to cause a seal to form between the wrap and board blank along the scores. The amount of pressure required will vary depending upon the adhesives and materials of the wrap and blank. For example, for a 40 point chipboard blank, a laminated paper wrap glued together by heated animal glue approximately 35 lbs/in$^2$ to 95 lbs/in$^2$ of pressure has been found to be sufficient to result in a good seal between the board blank and wrap.

Optionally, after scoring the wrapped board blank 20 may have a glue inserted into it so that it may receive various inserts including cartridges for receiving compact disks, optical disks, tape cassettes, DAT cassettes. Such gluing may be accomplished in-line by a gluing station 6. Other stations for inserting cartridges 7 may be included in-line, as well as a station for manual insertions 8, e.g., of compact discs or pamphlets.

The box may then be optionally closed, either by hand or by machine. A preferred method of closing the box includes the use of a box closing station 9 that closes the box in an upright position, i.e., closed so that the spine of the box is parallel to the assembly line 10 and the planes of the top and bottom of the box are perpendicular to the plane of the assembly line 10. This allows for ready stacking of the boxes so that they may be counted automatically and readied for shipping without requiring additional human intervention.

Figure 10:
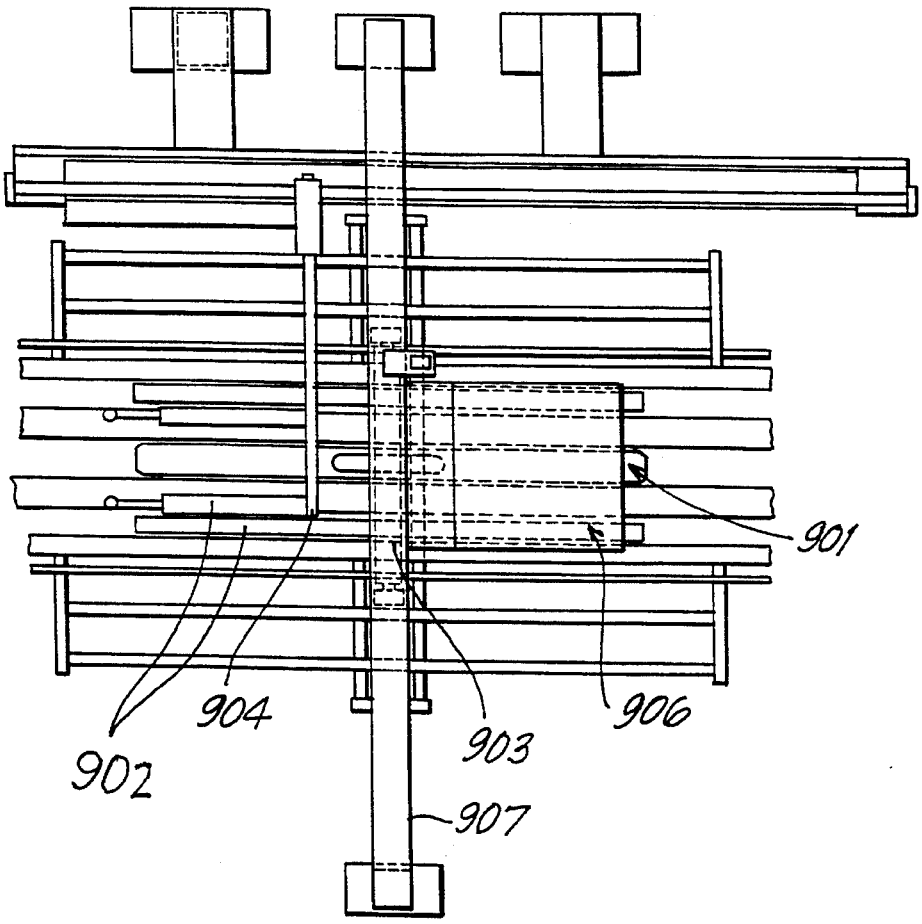
FIG. 10 illustrates a side view of an upright box closing station.
Figure 11:
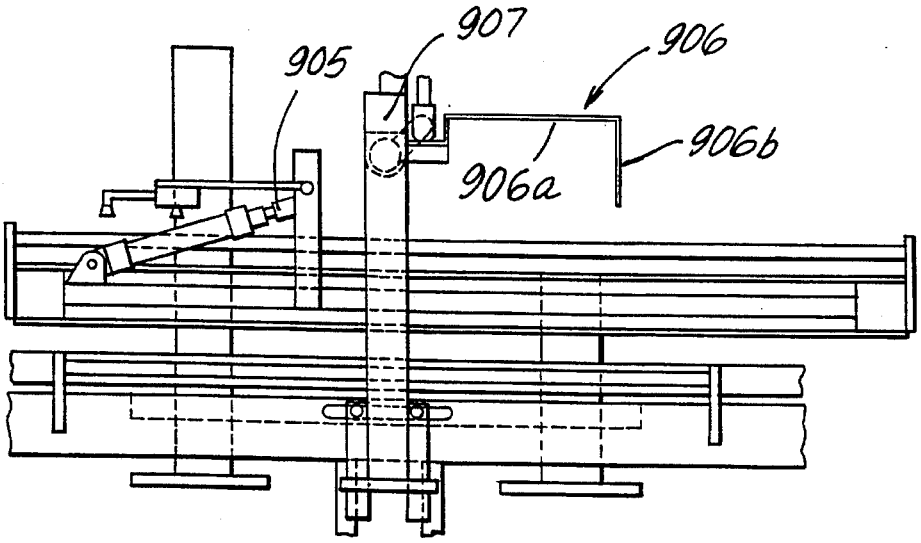
FIG. 11 illustrates a top view of an upright box closing station.
Figure 12:
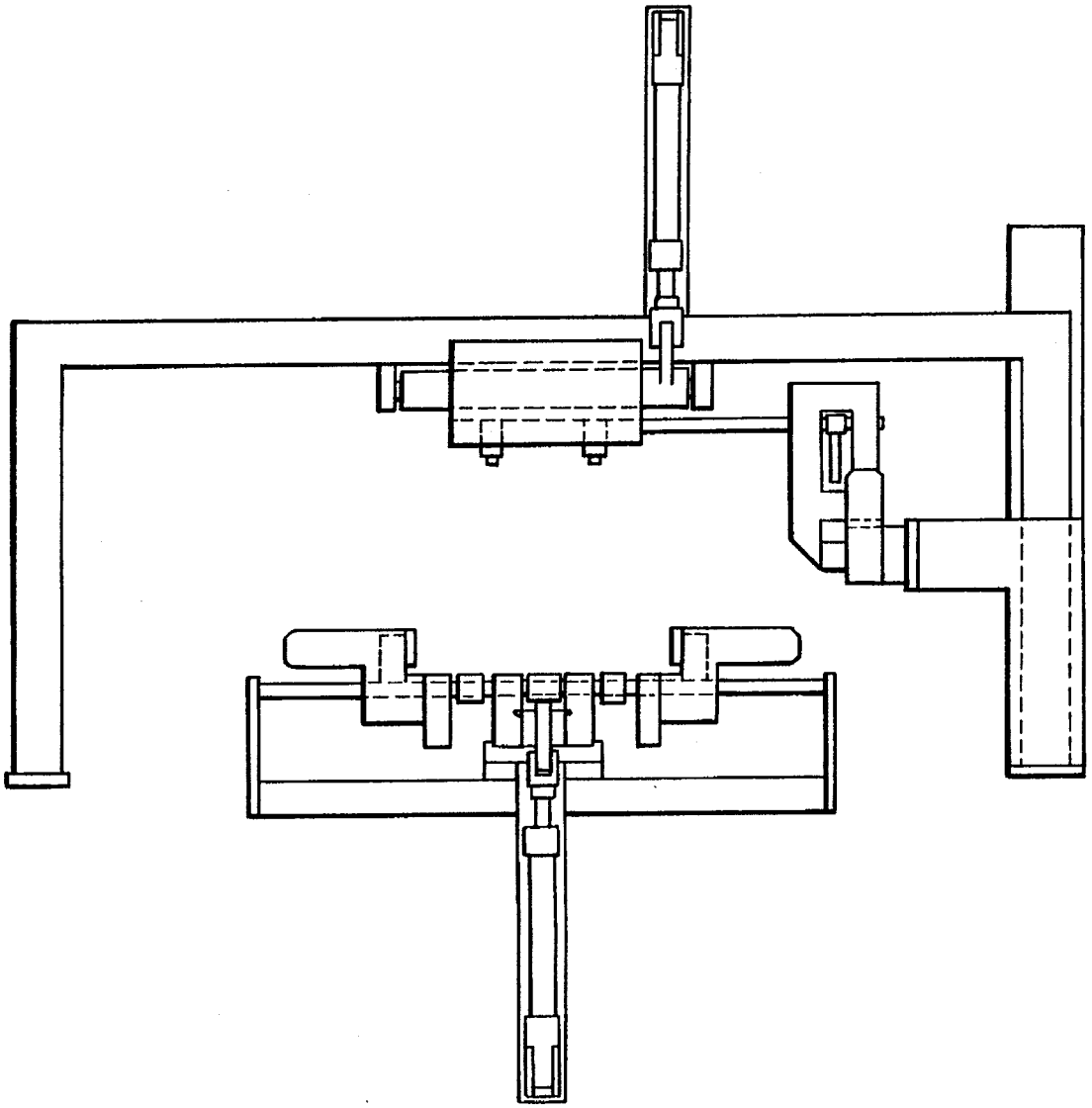
FIG. 12 illustrates a front view of an upright box closing station.

An exemplary box closing station 9 is illustrated in FIGS. 10–12. The box closing station 9 is comprised of an L-shaped arm 906 pivotally mounted on a frame 907 and a jaw with an upper 901 and lower 902 fingers disposed below the plane of travel of the box (wrapped blank 20) and pivotally mounted on said assembly line 10. Said fingers 901, 902 are offset by the width of the spine 245 of the wrapped blank 20 so that the distance between the hinges 903, 904, about which the upper and lower fingers 901, 902 rotate, respectively, should be slightly larger than the spine of the box 245. The L-shaped arm 906 has a length portion 906*a* and a width portion 906*b* joined at a right angle. The arm 906 swings down from its resting position so that the width portion 906*b* is parallel to the plane of the assembly line 10. The length portion 906*a* should be long enough so that the width portion 906*b* is resting just above the wrapped blank 20. The upper finger 901 rotates up from the plane of the assembly line 10 to a position perpendicular to the plane of the assembly line 10, thereby pushing the top of the box 246 against the edge of the width portion 906*b* which is not attached to the length portion 906*a*, trapping the top of the box 246 between the finger 901 and the width portion 906*b* and bringing the top 246 to an orientation perpendicular to the plane of the assembly line 10. The arm 906 then returns to its resting position.

The lower finger 902 then rotates from the plane of the assembly line 1 to a position perpendicular to said assembly line 1, thereby pushing the bottom of the box 247 to an orientation perpendicular to the assembly line 1 and parallel to the plane of the top of the box 246 and grasping the entire box 20 between the fingers 901, 902. This results in the top 246 and bottom 247 of the box 20 meeting at an angle perpendicular to the assembly line 1 and closing the box 20. The fingers 901, 902 may then drop away and the box 20 may be moved along the assembly line 10 by a movement means within the assembly 10.

Once the boxes are closed by such a method which leaves them upright as described above they may be sent to a product accumulator 10 which may count the boxes in upright positions as the boxes enter the accumulator. Said counting may be accomplished by means of a microprocessor or microswitches, e.g., with an electric eye. The accumulator 10 may include a driving means which pushes a fixed number of boxes, counted by the accumulator 10, out of the line of the assembly line 1. This would allow for ready packing of boxes according to carton size. For example, where a carton can hold ten stacks of five boxes the accumulator 10 may be set to counts of five and when it pushes out ten sets of five boxes, the carton will be full.

We claim:

1. A method for manufacturing single piece boxes comprising:

a. wrapping a wrap around a board blank so that the said board blank and wrap are aligned;

b. cutting notches into the wrap and board blank to form a spine region; and c. score setting the spine region of the wrapped board blank to form a seal between the wrap and the board blank.

2. A method according to claim 1 additionally comprising inserting glue into said wrapped blank.

3. A method according to claim 2 additionally comprising inserting into said wrapped board blank cartridges for receiving inserts selected from the group consisting of compact disks, optical disks, tape cassettes and DAT cassettes.

4. A method according to claim 3 additionally comprising inserting into said cartridge an insert selected from the group consisting of compact disks, optical disks, tape cassettes and DAT cassettes.

5. A method according to claim 3 additionally comprising closing the wrapped blank in an upright position.

6. A method according to claim 3 additionally comprising counting the wrapped blank.

7. A method according to claim 1 wherein the board blank is comprised of a material selected from the group consisting of plastic, cardboard, chipboard and cardstock.

8. A method according to claim 1 wherein the wrap is comprised of a material selected from the group consisting of paper, fabric and plastic.

9. A method according to claim 1 wherein the board blank and wrap are aligned by means of an in-line scanner.

10. A method according to claim 1 wherein the score is set along the entire spine region.

11. A method according to claim 1 wherein the score is set along the borders of the spine region of the wrapped board blank.

12. A method according to claim 1 wherein the board blank and the wrap are aligned after the notches are cut.

13. A method according to claim 1 additionally comprising cutting a thumb notch into the wrapped blank.

14. A machine for making single piece boxes comprising:

a. means for wrapping a wrap around a board blank so that the board blank and wrap are aligned;

b. means for cutting notches into the wrap and board blank to form a spine region; and.

c. means for score setting the spine region of the wrapped board blank to form a seal between the wrap and the board blank.

15. A machine according to claim 14 additionally comprising a means for inserting glue into said box.

16. A machine according to claim 15 additionally comprising means for inserting into said wrapped board blank cartridges for receiving inserts selected from the group consisting of compact disks, optical disks, tape cassettes and DAT cassettes.

17. A machine according to claim 16 additionally comprising a means for closing the wrapped blank in an upright position.

18. A machine according to claim 17 additionally comprising means for counting the wrapped box.

19. A machine according to claim 14 wherein the board, blank is comprised of a material selected from the group consisting of plastic, cardboard, chipboard and cardstock.

20. A machine according to claim 14 wherein the wrap is comprised of a material selected from the group consisting of paper, fabric and plastic.

21. A machine according to claim 14 wherein the board blank and wrap are aligned by means of an in-line scanner.

22. A machine according to claim 14 wherein the score is set along the entire spine region.

23. A machine according to claim 14 wherein the score is set along the borders of the spine region of the board blank.

24. A machine according to claim 14 additionally comprising a means for cutting a thumb notch into the wrapped blank.

25. A one-piece box made by the machine claimed in claim 14.

26. A method for score setting a wrapped board blank with a spine region comprising striking the spine region of a wrapped board blank with sufficient pressure to form a seal between the board blank and the wrap at the spine region.

27. A method according to claim 26 wherein the spine region is struck at the borders of the spine region.

28. A method according to claim 26 wherein the spine region is struck along the entire spine region.

29. A method according to claim 26 wherein the wrapped blank is struck with about 35 lbs/in$^2$ to about 95 lbs/in$^2$ of pressure.

30. A method according to claim 26 wherein the wrapped blank is struck by a die.

31. A method according to claim 30 wherein said die is comprised of two pieces of creased rule separated by a space.

32. A method according to claim 31 wherein the space between the two pieces of creased rule is adjustable.

33. A method according to claim 30 wherein said die is comprised of single block.

34. A one piece box score setter comprising:

a. a striking means for striking the spine region of a one piece box comprising a wrap and a board blank with sufficient pressure to form a seal between the board blank and the wrap at the spine region of the box;

b. a driving means for driving said striking means; and c. a base for supporting the box.

35. A score setter according to claim 34 additionally wherein said striking means is a die.

36. A score setter according to claim 35 wherein said die is comprised of two pieces of creased rule separated by a space.

37. A score setter machine according to claim 36 wherein the space between the pieces of creased rule may be adjusted.

38. A score setter according to claim 35 wherein said die is comprised of a single block.

39. A score setter according to claim 34 wherein said drive means provides from about 35 lbs/in$^2$ to about 95 lbs/in$^2$ of pressure.

40. A box closer for closing a one piece box with a top, bottom and spine in an assembly line comprising:

a. an L-shaped arm pivotally mounted on a frame comprising a length portion and a width portion joined at fight angles positioned so that when the arm rotates from a resting position above the assembly line, the width portion is parallel to the plane of the assembly and rests just above the assembly line;

b. an upper finger disposed below the plane of travel of the box and pivotally mounted on the assembly line to rotate into the top of the box and perpendicular to the plane of travel of the box and parallel to the spine of the box; and c. a lower finger disposed below the plane of travel of the box and pivotally mounted on the assembly to rotate into the bottom of the box and perpendicular to the plane of travel of the box and parallel to the spine of the box.

41. A box closer according to claim 40 wherein the upper and lower fingers are offset by the width of the spine of the box.

42. A box closer according to claim 40 wherein the frame is mounted onto the assembly line.

43. A box closer according to claim 40 wherein the L-shaped arm is shaped so that when it is swung down the end of the width portion runs coterminous for the length of the top region and the spine region.

44. A method for closing a one piece box with a top, bottom and spine in an assembly line comprising:

a. rotating an L-shaped arm pivotally mounted on a frame comprising a length portion and a width portion joined at fight angles positioned from a resting position above the assembly line, so that the width portion is parallel to the plane of the assembly and rests just above the assembly line;

b. rotating an upper finger disposed below the plane of travel of the box and pivotally mounted on the assembly line into the top of the box, perpendicular to the plane of travel of the box and parallel to the spine of the box and thereby catching the top of the box between the upper finger and the arm perpendicular to the plane of travel of the box;

c. rotating the L-shaped arm to its resting position; and d. rotating a lower finger disposed below the plane of travel of the box and pivotally mounted on the assembly into the bottom of the box and perpendicular to the plane of travel of the box and parallel to the spine of the box and thereby pushing the bottom of the box into the top of the box and closing the box between the upper and lower fingers.

45. A method for closing a box according to claim 44 wherein the upper and lower fingers are offset by the width of the spine of the box.

46. A method for closing a box according to claim 44 wherein the frame is mounted onto the assembly line.

47. A method for closing a box according to claim 44 wherein the L-shaped arm is shaped so that when it is swung down the end of the width portion runs coterminous for the length of the top region and the spine region.

* * * * *